US005179900A

United States Patent [19]

Schwitzky

[11] Patent Number: 5,179,900

[45] Date of Patent: Jan. 19, 1993

[54] CONTROLLABLE GRIPPER ASSEMBLY

[75] Inventor: Volkmar R. Schwitzky, Oberduerrbach, Fed. Rep. of Germany

[73] Assignee: Koenig & Bauer Aktiengesellschaft, Wirzburg, Fed. Rep. of Germany

[21] Appl. No.: 896,665

[22] Filed: Jun. 10, 1992

[30] Foreign Application Priority Data

Jun. 11, 1991 [DE] Fed. Rep. of Germany ..... 4119118

[51] Int. Cl.[5] ..... B41F 21/04; B65H 29/28; B65H 29/04

[52] U.S. Cl. ..... 101/240

[58] Field of Search ..... 101/232, 236, 237, 238, 101/239, 240, 241, 242, 408, 409, 410–412; 271/3.1, 278, 82, 207, 314, 277; 198/803.9, 803.1, 799, 832.2, 832.3

[56] References Cited

FOREIGN PATENT DOCUMENTS 87048 1/1972 German Democratic Rep. .
2040670 8/1970 Fed. Rep. of Germany .

*Primary Examiner*—J. Reed Fisher
*Attorney, Agent, or Firm*—Jones, Tullar & Cooper

[57] ABSTRACT

A controllable gripper assembly utilizes spaced plates attached to transport chains. A gripper carriage is carried between the plates and is slidable with respect to the transport chain. Movement of the gripper carriage in a direction opposite to that of the transport chains will allow the sheet being transported by the gripper carriage to be released for deposit on a sheet stack with essentially no forward velocity.

6 Claims, 4 Drawing Sheets

CONTROLLABLE GRIPPER ASSEMBLY

FIELD OF THE INVENTION

The present invention is directed generally to a controllable gripper assembly. More particularly, the present invention is directed to a controllable gripper assembly for a sheet gripper. Most specifically, the present invention is directed to a controllable gripper assembly for a sheet gripper for the delivery of sheets in a printing press. The controllable gripper assembly allows the sheet gripper to be slowed below the speed of travel of the transport chains to which the sheet gripper units are attached. As the individual gripper units are slowed down, the sheet which each gripper unit is transporting is released and can be deposited on a sheet stack against sheet stops without damage being done to the sheets. The gripper units utilize gripper carriages which are slidably carried by gripper plates. The gripper carriages move with respect to the transport claims to effect a slowing of the speed of sheet travel.

DESCRIPTION OF THE PRIOR ART

Sheet delivery devices are generally known in the art and are utilized to transport sheets from a printing press to a sheet stacking assembly or sheet delivery pile. In such sheet delivery devices where the sheets are conducted by transport chains to the delivery pile by means of chains moving at a constant speed, it is necessary to reduce the forward feed speed of the transported sheets to be delivered. The transport speed of the sheets has to be slowed to a speed approaching zero forward movement at the moment the sheet is deposited on the sheet pile. If the speed of the sheet is not reduced, the sheets are apt to be damaged and the sheet stack may not be a well-stacked pile.

One prior art sheet delivery system is shown in East German Patent DD-WP 87 048. In this device, a sheet gripper carriage is fastened on revolving transport chains by means of connectors. The speed reduction of the gripper carriage is accomplished by means of the separation of the track of the gripper carriages from the chain track. A reversing wheel, which is disposed eccentrically in relation to the gripper carriage reversing path and has the shape of an arc of a circle, is provided for disconnecting the transport chain. The shaft of the reversing wheel is disposed below the center of the gripper carriage reversing path. In this way the transport chain with the hinge point of the connector of the gripper carriage is separated by means of the reversing wheel which is disposed eccentrically in relation to the gripper carriage path. In the course of this, the transport chain travels a longer distance than the gripper carriage. This longer distance of travel of the transport chain causes the speed of the gripper carriage and thus the speed of the sheet being transported to be reduced.

One limitation of the sheet delivery assembly shown in this prior art device is that it is necessary to provide two guide paths, one for the transport chain and the other for the gripper carriage. The slowing of the grippers in the delivery area provided in this device is approximately 20 to 30 percent of the running speed of the machine and remains constant, since in the reversing area the chain has only a limited opportunity to be separated in relation to the gripper carriage, which results in the limited difference in speed between the gripper carriage and the chain.

Since this prior art sheet delivery assembly is capable of effecting only a limited reduction in the speed of the gripper carriages with respect to the transport chain in the area of the sheet stack area, it is necessary to employ additional devices to slow the speed of sheet travel. Typically, a suction roller, or similar suction elements are employed for slowing down the sheets of printed material. This is apt to be quite disadvantageous in the case of the use of the sheet work method since the printed reverse side of the sheet is apt to be damaged. Also, when the sheet transport assembly is being used to transport printed cardboard sheets, the high kinetic energy of the sheets may be such that the high suction source which would be necessary to slow and stop the sheets is not available. If the sheets cannot be adequately slowed or stopped, they will be deposited with a high residual speed at the sheet stops. This contact between the moving sheets and the sheet stops leads to damage of the front edges of the sheets.

If the transported sheets are not slowed down before being released from the sheet grippers, they may well overshoot the sheet stops. The tendency of the sheet to overshoot the sheet stops increases with increasing machine speed. This tendency of the sheets to overshoot the sheet stack is attempted to be counteracted by using large amounts of blowing air to limit sheet overshooting. A significant limitation on the use of air under pressure is that it tends to form air pockets between the individual sheets in the stack of sheets. This leads to a reduction in quality of the stack formation.

A further limitation of the sheet delivery device shown in the prior art East German Patent DD-WD-87048 is that the totality of the mass inertia forces created because of the slowing of the gripper carriages acts on the pulling forces on the chains. This is apt to cause wear on the chain and the gripper carriages.

It will be apparent that a need exists for a controllable gripper assembly which will slow the delivery of sheets in a manner which overcomes the limitations of the prior art devices. The controllable gripper assembly of the present invention provides such a device and is a significant advance in the art.

SUMMARY OF THE INVENTION

It is an object of the present invention to provide a controllable gripper assembly.

Another object of the present invention is to provide a controllable gripper assembly for a sheet gripper.

A further object of the present invention is to provide a controllable gripper assembly for a sheet gripper for the delivery of sheets in a printing press.

Yet another object of the present invention is to provide a controllable gripper assembly for the slowed delivery of printed sheets to a sheet stack.

Still a further object of the present invention is to provide a controllable gripper assembly in which the speed of the grippers can be varied over a wide range of speeds.

Even yet another object of the present invention is to provide a controllable gripper assembly in which the effect of the mass inertia forces on the transport chains is reduced.

As will be discussed in greater detail in the description of the preferred embodiments which are set forth subsequently, the controllable gripper assembly in accordance with the present invention utilizes a plurality of sheet grippers which are arranged on a gripper carriage. The gripper carriage is, in turn, slidably supported in guides that are carried by plates which are attached to the spaced transport chains. A spring is used to bias the carriage and to allow it to be slid in the direction opposite to that of the direction of travel of the transport chains to thus slow down the transport speed of the sheet held by the grippers on the carriage. A pair of connector arms are attached to the carriage and to the plates. These connectors are joined by a toggle joint that is caused to move to slide the carriage in the side plates. The toggle joint is caused to move by engagement with a curved cam track.

The controllable gripper assembly of the present invention makes it possible to deposit sheets in a sheet stack at any speed. Further, by varying the profile of the curved cam track, the speed of sheet deposit in the sheet stack can be held constant over a range of machine speeds and hence transport chain speeds.

Since the controllable gripper assembly allows the sheets to be slowed down to nearly no forward speed, it is possible to operate the suction roller or other similar suction source that is also used to decelerate the sheets with very little suction force. This use of little suction force is a particular benefit for sheet work. In addition, much less air is blown onto the sheet stack so that the quality of the stack is improved as there are less apt to be air pockets in the sheet stack. The use of less air also helps eliminate the appearance of ink smears when the sheets are deposited on the sheet stack.

The controllable gripper assembly of the present invention also eliminates the overshooting of the sheets beyond the bottom sheet stops and their associated shaft. In addition, the leading edges of the sheets are not deformed when they contact the sheet stops due to the low forward speed of the printed materials. A further benefit of the assembly is that the effect of the mass inertia forces on the gripper carriages in the course of their slow-down is reduced because the greater part of these forces is equalized within the gripper units. The balance of these forces can be compensated for by providing an equal and opposite force through the proper structuring of the lead in and lead out portions of the curved cam tracks. This allows the gripper carriages of two spaced gripper assemblies to move in opposing directions at the same time.

It will thus be seen that the controllable gripper assembly of the present invention overcomes the limitations of the prior art devices. It provides a device which is a substantial advance in the art.

BRIEF DESCRIPTION OF THE DRAWINGS

While the novel features of the controllable gripper assembly in accordance with the present invention are set forth with particularity in the appended claims, a full and complete understanding of the invention may be had by referring to the description of the preferred embodiments, which are presented subsequently, and as illustrated in the accompanying drawings, in which:

DESCRIPTION OF THE PREFERRED EMBODIMENTS

Figure 1:
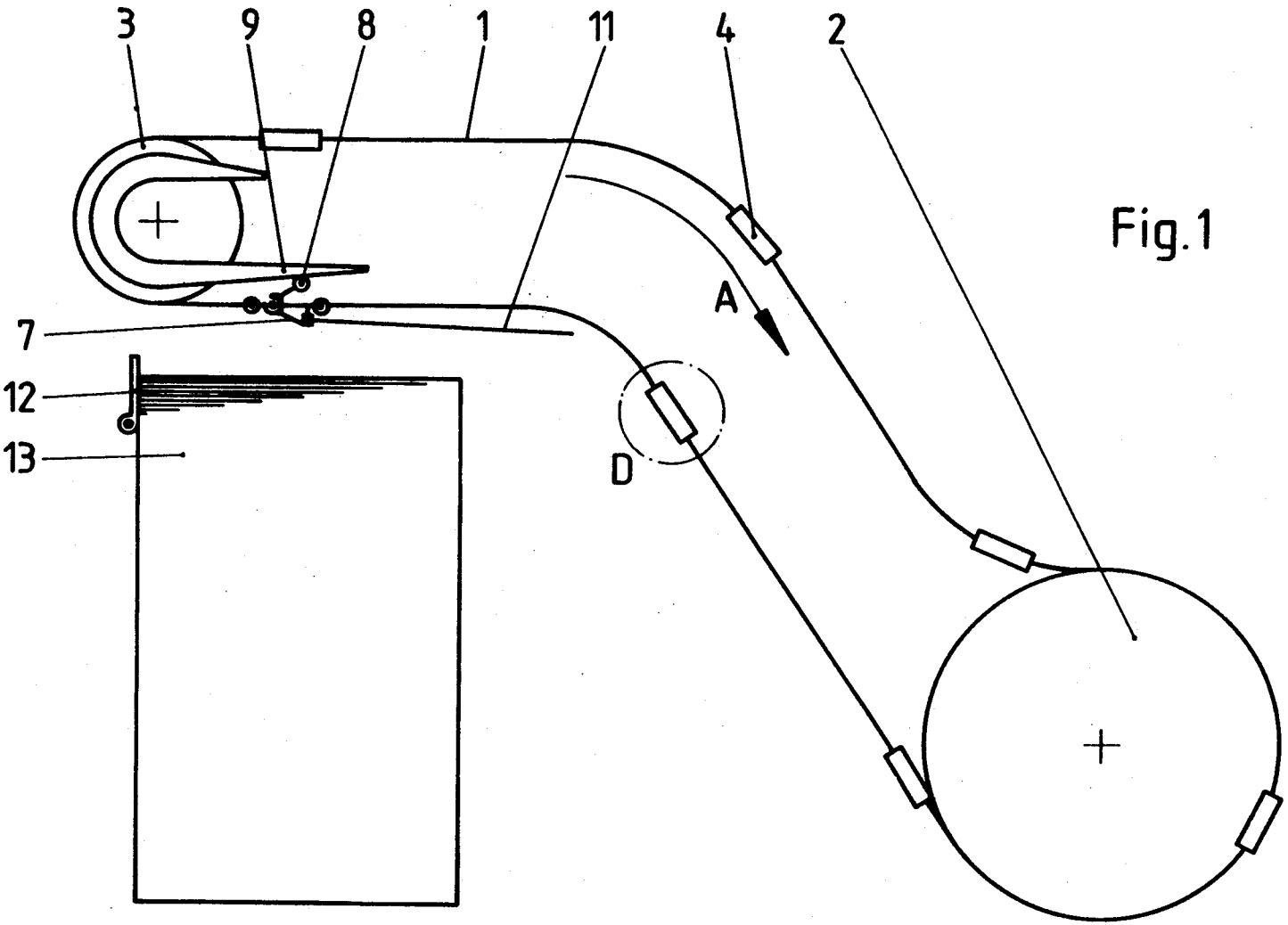
FIG. 1 is a schematic view of a transport chain and guides with a controllable gripper assembly for a sheet-fed rotary printing press in accordance with the present invention.

Referring initially to FIG. 1, there may be seen a preferred embodiment of a controllable gripper assembly in accordance with the present invention. A transport chain, generally at 1, travels about a path and transfers printed sheets from a suitable printing unit (not shown) to a sheet stack, generally at 13. It will be understood that the transport chain 1 shown in FIG. 1 is typically one of a pair of similar spaced transport chains 1, as seen in FIG. 2.

The transport chain 1 is conducted over a suitable chain wheel 2 and a chain reversing wheel 3. A plurality of chain guides, which are not specifically shown, are placed along the paths of chain travel. A plurality of controllable gripper units 4 are secured to the transport chain 1 at selected distances. It will be understood that each gripper unit 4 extends between the two spaced transport chains 1, as may be seen generally in FIG. 2 and further that the chain wheels 2 and the chain reversing wheels 3 for the two transport chains operate in p irs and are connected by suitable shafts which are not specifically shown.

Again referring to FIG. 1, each controllable gripper unit 4 has a plurality of generally conventional sheet grippers 7. In the gripper unit shown in FIG. 1, the unit is about to engage the chain reversing wheel 3 and the transport chain 2 is moving in the direction indicated by arrow A. The gripper unit 4 moves into engagement with a curved control cam 9 that is engaged by a roller lever 8 which releases the gripper 7 so that a sheet 11 will be released and will be deposited against the sheet stops 1 on the sheet stack 13.

Figure 2:
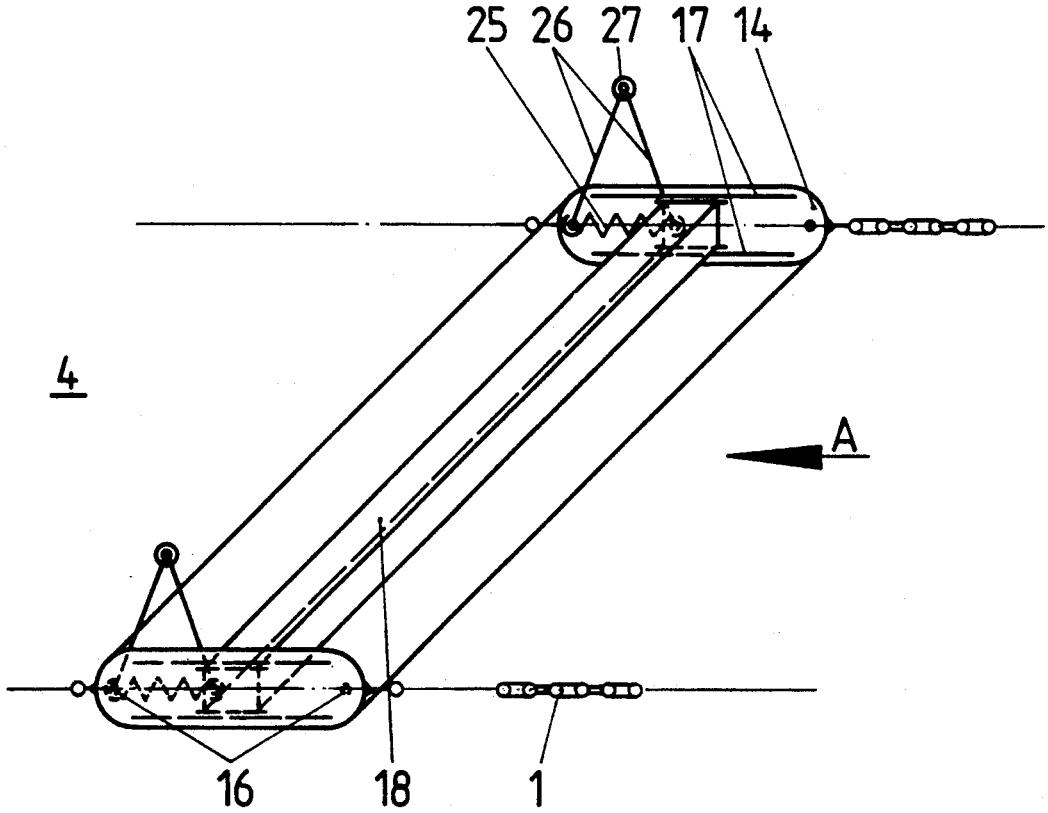
FIG. 2 is a perspective view of a controllable gripper unit taken in the encircled portion of FIG. 1.
Figure 3:
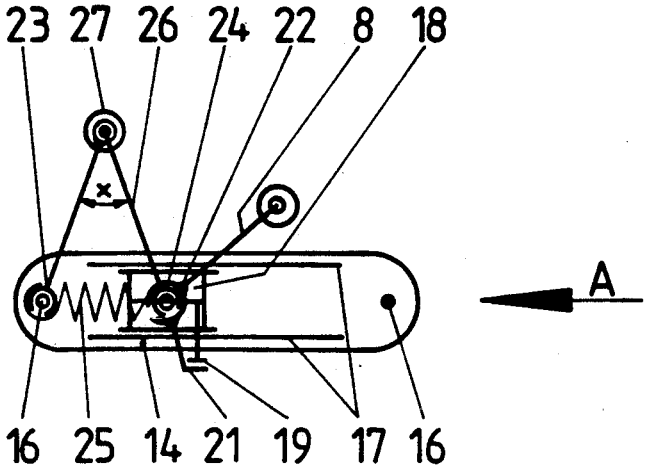
FIG. 3 is a schematic view of a first preferred embodiment of a controllable gripper unit in its sheet transport position.

Referring now primarily to FIGS. 2 and 3 there may be seen a first preferred embodiment of a controllable gripper unit, generally at 4, in accordance with the present invention. FIG. 2 is a perspective view and shows the gripper unit 4 extending between the two spaced elongated transport chains 1. Each gripper unit 4 utilizes a pair of spaced gripper plates 14 with one such plate being secured to each of the transport chains 1 by spaced bearing bolts 16. Each plate 14 has a pair of guides 17 which are disposed longitudinally on the inner surface of the plate and extend generally parallel to the transport chains 1. The plates 14 are hingedly connected to the chains 17 so that they can move as the chains 1 go around the chain wheel 2 and the chain reversing wheel 3.

A gripper carriage 18 is slidably carried between the two spaced plates 14 and slides in the guides 17. The gripper carriage 18 carries a plurality of sheet grippers which are all identified by reference numeral 7. These grippers include gripper striking faces 19, gripper levers 21, a roller lever 8 and the gripper shaft 22. It will be understood that the gripper roller lever 8 is usable to open and close the grippers in a generally known manner by engagement with a suitable cam plate or the like. A tension spring 25 is disposed between a hinge pin 23 on the plate 14 and a hinge pin 24 on the slidable carriage 18. A first free arm end of a toggle lever 26 is connected to the hinge 23 while a second free arm end of the toggle lever 26 is secured to the slidable carriage 8. The two arms of the toggle lever 26 join at a hinge joint where they are connected to a curve roller 27.

Figure 4:
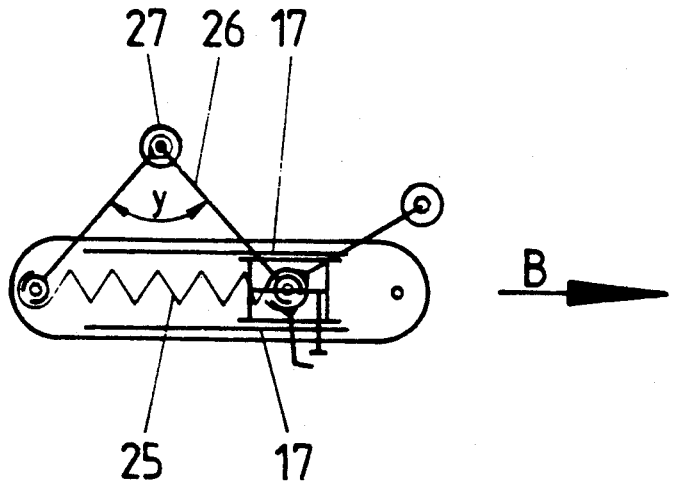
FIG. 4 is a view similar to FIG. 3 and showing the controllable gripper unit in its sheet slow down position.
Figure 5:
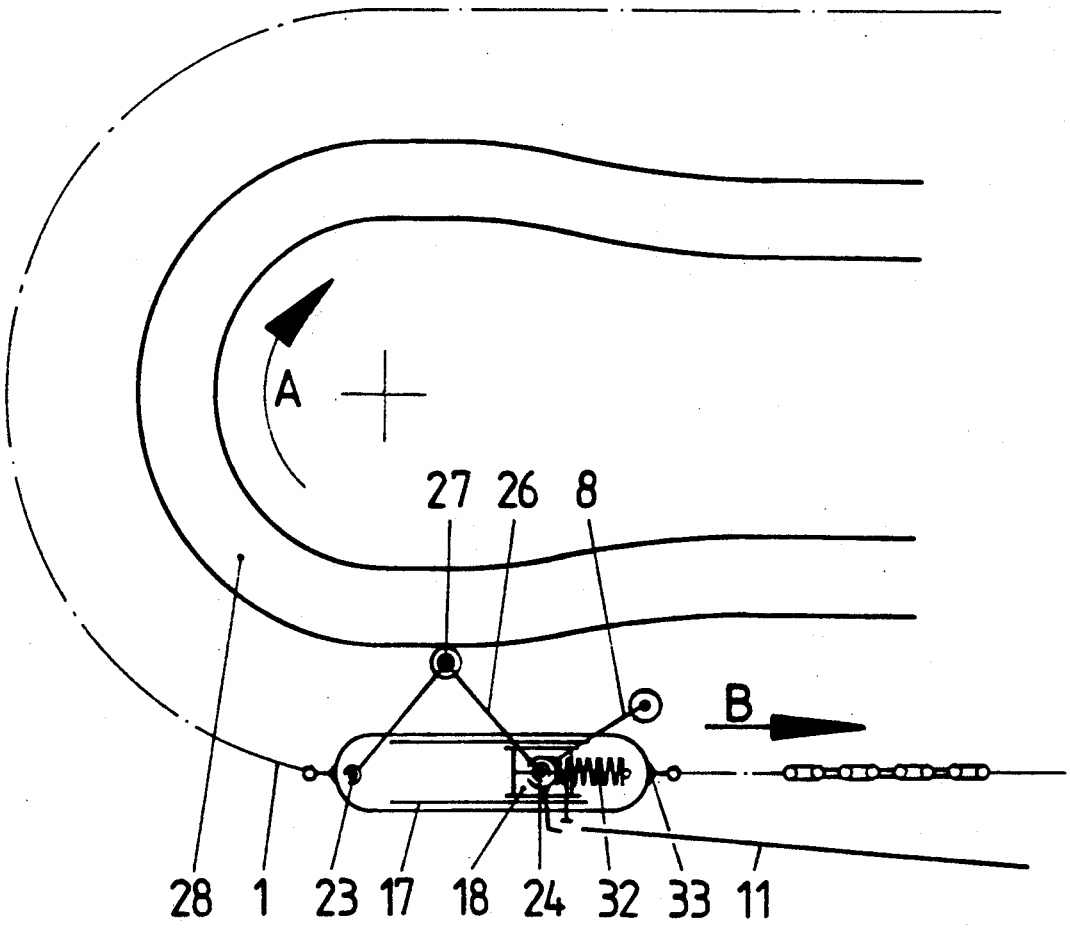
FIG. 5 is a schematic view of a second preferred embodiment of a controllable gripper unit of the present invention and showing the transport chain being reversed at the sheet deposit position.

As may be seen by comparing FIGS. 3 and 4, in which FIG. 3 shows the gripper unit 4 in a sheet transport position and FIG. 4 shows the gripper unit 4 in a sheet release position, the toggle lever 26 is operable by engagement of the curve roller 27 with a contoured gripper opening curve cam 28, as may be seen in FIG. 5, and the gripper carriage 18 is slid in the guides 17 in the direction indicated by arrow B against the force of the tension spring 25 and opposite to the direction of movement of the transport chains 1. The angle of the toggle lever 26 has increased form a value of x seen in FIG. 3 to a larger value y, as seen in FIG. 4. This movement of the gripper carriage 18 in a direction opposite to the direction of movement of the transport chains 1 has the effect of stopping the forward speed of the sheet 11 so that when it is released by movement of the roller lever 8, it will fall onto the sheet stack 13 and will abut the sheet stops 12 with a minimal forward speed.

In the first preferred embodiment of the controllable gripper unit 4 shown in FIGS. 2 and 3, the carriage 18 slides in the direction B against the force of the tension spring 25. In the second preferred embodiment shown in FIG. 5, the gripper carriage 18, as it moves in the direction B is opposed by a compression spring 32. In this situation the compression spring 32 is fastened to the gripper carriage 18 at hinge point 24 and to the plate 14 at an attachment point 33. It would be possible in both of the first and second preferred embodiments to substitute other devices for the tension spring 25 or the compression spring 32. For example, gas springs or a leg spring could be used. If a leg spring were utilized, it would be positioned at the joint of the toggle lever 26 opposite the curve roller 27 and would engage the two arms of the toggle lever 26. It would also be possible to use a torsion bar which would be positioned in hollow transverse tie bars between the plates 14.

As the controllable gripper unit depicted in FIG. 5 passes around the transport chain reversing wheel and its curve roller 27 engages the control curve cam 28, the gripper carriage 18 first slides in the direction indicated by arrow B, and after the gripper unit has moved around the control curve cam 28, the carriage 18 again moves in the direction A. Only a small portion of the mass inertia forces arising during the shifting of the carriage 18 and its subsequent acceleration acts on the tensile load in the transport chains 1 and thus induces a torque load on the machine. The major part of these forces is equalized inside the gripper unit 4.

Figure 6:
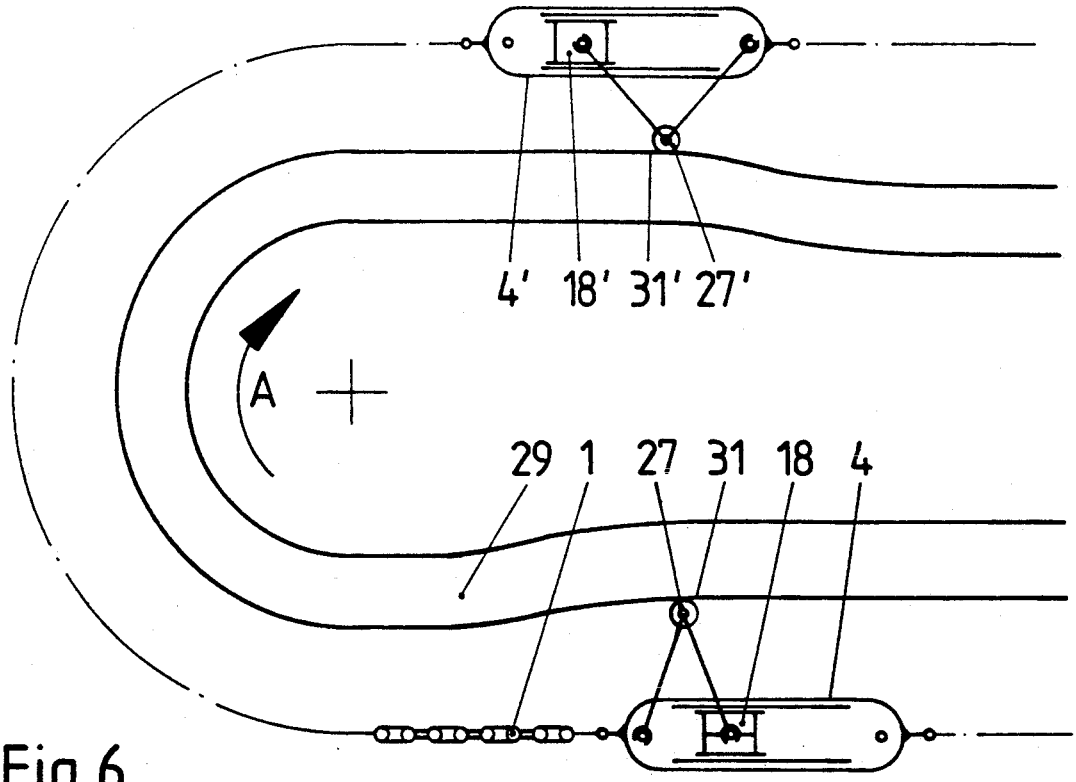
FIG. 6 is a schematic view generally similar to FIG. 5 and showing opposing controllable gripper units.

These mass inertia forces may be reduced even further by utilizing an arrangement of gripper units 4 and a control curve cam 29, as shown in FIG. 6. The curve control cam 29 is shaped in such a way that at the time the lower gripper unit 4 enters the curve and places the curve roller 27 in the curve lead-in 31, the gripper unit 4' which, looking in the transport direction A, has preceded it, engages the curve lead-out 31' with its curve roller 27' at the same time. The shapes of the curve lead-in 31 and lead-out 31' for the gripper units 4, 4' assure that the still remaining portion of the mass inertia forces acting on the transport chains I are equalized by the oppositely acting mass inertia forces of the gripper units 4, 4' in that the carriage 18' of the gripper unit 4' experiences acceleration at the start of its movement through the curve 29 in the curve lead-out 31', while the carriage 18 of the gripper unit 4 experiences deceleration at the start of its movement through the curve 29 in the curve lead-in 31. In this case the curve 29 with the curve lead-in 31 and lead-out 31' is embodied in such a way that the curve rollers 27, 27' of the gripper units 4, 4' pass the respective curve lead-in 31 and lead-out 31' at the same time.

Figure 7:
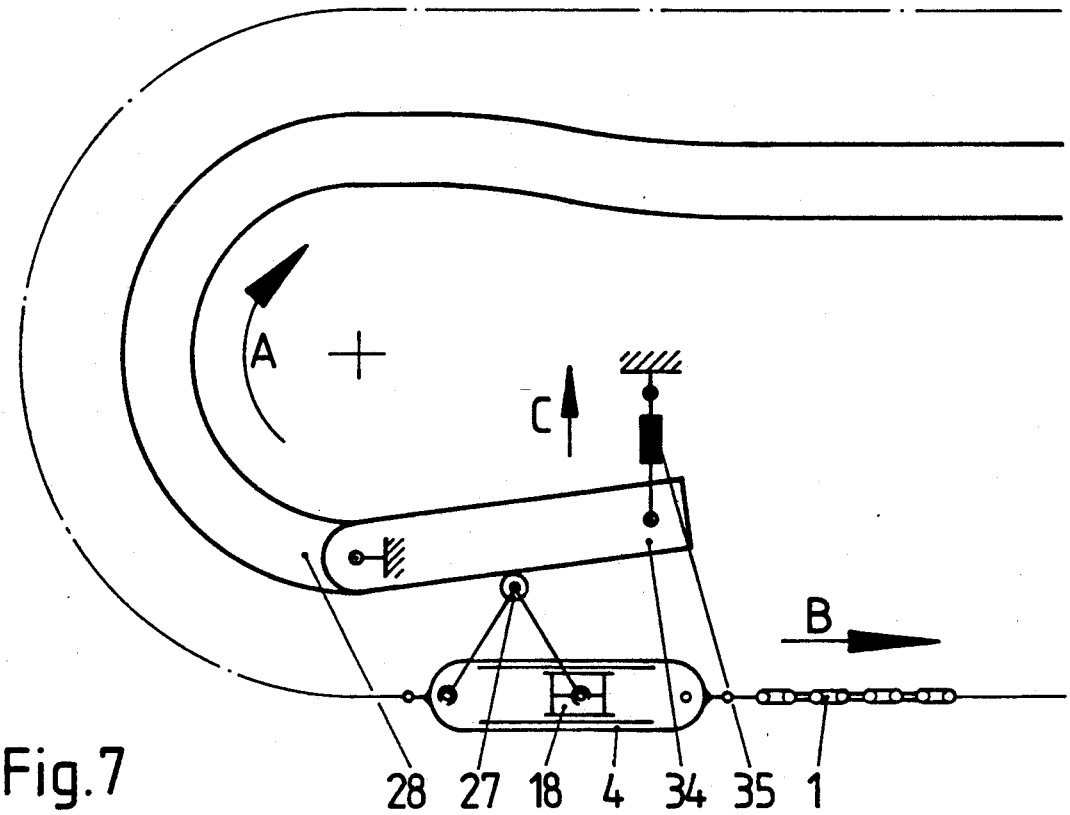
FIG. 7 is a schematic view of the controllable gripper assembly of the present invention and showing an adjustable control cam curve section.

In the embodiment of the controllable gripper assembly depicted in FIG. 7, there is shown an adjustable control curve cam 28 for use with the chain reversing wheel 3 end of the assembly. In this depiction, the details of the controllable gripper unit 4 have been left out for the sake of simplicity. The control curve cam 28 is connected by a hinge joint to an adjustable cam element 34. This cam element 34 is adjustable by a control element 35 which may be a servo motor or other device that can be operated mechanically, pneumatically, hydraulically, or in a similar manner. An adjusting spindle could be provided as the control element 35 so that it could be adjusted manually. It is possible to operate the control element 35 independently of the machine speed via the machine control.

In the embodiment depicted in FIG. 7, the transport chains 1 move in the direction depicted by the arrow A. The controllable gripper unit 4 moves into the area of the adjustable curve element 34 and the curve roller 27 is actuated in the toggle joint 26 in such a way that the angle between the connectors of the toggle lever 26 changes from a value x to a value y, as shown in FIGS. 3 and 4. The gripper carriage 19 moves in the guides 17 in the direction of the arrow B; i.e. opposite to the transport direction A. By means of this relative movement, the carriage 18 is slowed down in relation to the chain revolution speed. The grippers 7 then open and the sheet 11 is placed on the sheet stack 13. By changing the position of the curve element 34, a depositing speed of almost zero in relation to the chain revolution speed is possible. Displacing the curve element 34 in the direction of the arrow C in FIG. 7 increases the retardation of the carriage 18, In this way, the slow-down of the carriage 18 can be adjusted as a function of the machine speed. Thus the same sheet deposit speeds can be achieved for different machine speeds.

While preferred embodiments of a controllable gripper assembly in accordance with the present invention is set forth fully and completely hereinabove, it will be apparent to one of skill in the art that a number of changes in, for example the type of transport chains used, the type of chain wheel and chain reversing wheel, the number of gripper units and the like may be made without departing from the true spirit and scope of the present invention which is accordingly to be limited only by the following claims.

What is claimed is:

1. A controllable gripper assembly for delivery of sheets in a printing press to a sheet stack, said controllable gripper assembly comprising:

first and second spaced, generally parallel transport chains which follow a path around chain wheel drive and chain reversing wheels;

a plurality of controllable gripper units secured to said first and second transport chains, each of said controllable gripper units having spaced first and second plates attached to said first and second transport chains;

a gripper carriage secured between each said first and second plates and slidable on said plates in, and opposite to, the direction of movement of said first and second transport chains;

releasable sheet gripping means on said gripper carriage; and means to slide said gripper carriage with respect to said first and second plates in a direction opposite to said direction of movement of said transport chains to reduce the speed of movement of said gripper carriage in said direction of said transport chains with respect to said transport chains.

2. The controllable gripper assembly of claim 1 wherein said means to slide said gripper carriage includes a toggle lever having first and second toggle arms, a first end of said first toggle arm being attached to one of said first and second plates and a first end of said second toggle arm being attached to said gripper carriage, a curve roller secured to a toggle joint formed at a point of intersection of second ends of said first and second toggle arms, and a control curve cam which is engagable by said curve roller.

3. The controllable gripper assembly of claim 1 further including spring means between each of said plates and said gripper carriage.

4. The controllable gripper assembly of claim 2 wherein said control curve cam has a lead-in curve portion and a lead-out curve portion and further wherein a first controllable gripper unit will be in engagement with said lead-out portion of said control curve cam as a second controllable gripper unit is in engagement with said lead-in portion of said control curve cam.

5. The controllable gripper assembly of claim 2 wherein said control curve cam has a fixed curve segment and an adjustable curve element.

6. The controllable gripper assembly of claim 5 further including a control element usable to adjust said adjustable curve element.

* * * * *